US005501630A

United States Patent [19]

Samsel

[11] Patent Number: 5,501,630

[45] Date of Patent: Mar. 26, 1996

[54] METHOD FOR GRINDING NEEDLE POINTS ON SURGICAL GRADE NEEDLE BLANKS

[75] Inventor: W. Scott Samsel, Bristol, Conn.

[73] Assignee: United States Surgical Corporation, Norwalk, Conn.

[21] Appl. No.: 266,743

[22] Filed: Jun. 28, 1994

Related U.S. Application Data

[62] Division of Ser. No. 959,054, Oct. 9, 1992, Pat. No. 5,388, 374.

[51] Int. Cl.[6] ..... B24B 1/00

[52] U.S. Cl. ..... 451/49; 451/58

[58] Field of Search ..... 451/49, 48, 58, 451/242, 244, 245, 331, 332, 333, 336, 337, 338, 339, 541

[56] References Cited

U.S. PATENT DOCUMENTS

| | | |
|---|---|---|
| 1,175,831 | 3/1916 | Spinney . |
| 1,486,435 | 3/1924 | Hunt . |
| 2,109,450 | 3/1938 | Schlayer et al. . |
| 2,170,672 | 8/1939 | Anderson . |
| 2,475,009 | 7/1949 | Catucci . |
| 2,528,042 | 10/1950 | Dean et al. . |
| 3,133,382 | 5/1968 | Messerschmidt . |
| 4,063,906 | 12/1977 | Wetzels . |
| 4,112,625 | 9/1978 | Wetzels . |
| 4,441,280 | 4/1984 | Wetzels et al. . |
| 4,977,709 | 12/1990 | Siden . |
| 5,155,943 | 10/1992 | Matsutani et al. . |

FOREIGN PATENT DOCUMENTS

| | | |
|---|---|---|
| 0282440 | 9/1988 | European Pat. Off. . |
| 3141276 | 8/1982 | Germany . |
| 4914613 | 4/1974 | Japan . |

OTHER PUBLICATIONS

The Automatic Point Grinding Machine Schumag Catalog.

The 3M Super Abrasives Diamond/CBN Products Catalog.

The Accu point™ Borazon Plated Wheels and Mandrels Catalog.

The Abrasive Technology Information Sheet.

European Search Report.

*Primary Examiner*—Maurina T. Rachuba

[57] ABSTRACT

Point-grinding apparatus comprising frame means, workpiece transport means operably mounted on the frame means for transporting a plurality of elongated workpieces therealong, workpiece support means disposed adjacent the transport means for supporting the elongated workpieces in contact with the transport means and grinding means including an asymmetrical concave grinding surface disposed adjacent the transport means to engage workpieces supported by the workpiece supporting means, the asymmetrical concave grinding surface being configured and dimensioned such that a surface area of each workpiece which contacts the grinding surface varies relative to the position of the workpiece with respect to the grinding surface. A method for grinding needle points is also provided including the steps of, providing a rotating grinding wheel having an asymmetrical concave grinding surface and feeding at least one workpiece to a first position such that each at least one workpiece is advanced along the grinding surface. Preferably, the method further comprises the step of removing the workpiece from between the transport wheel and the workpiece support means at a second position thereof.

17 Claims, 8 Drawing Sheets

FIG. 6
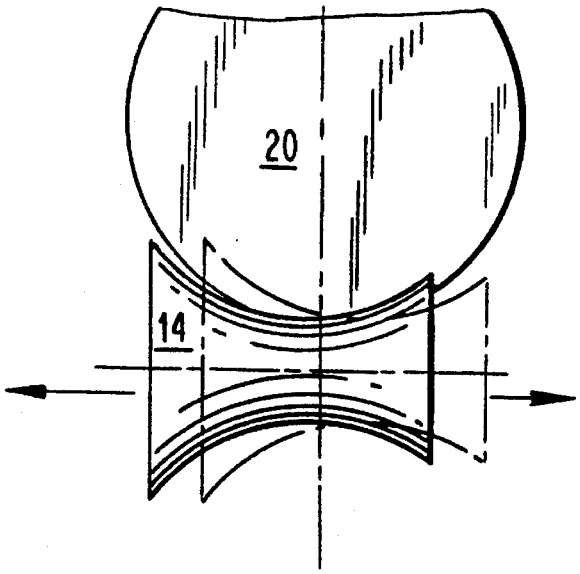
FIG. 7
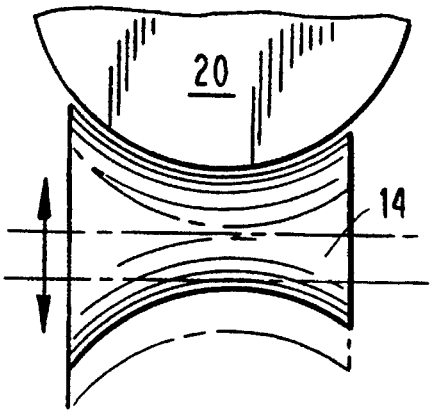
FIG. 8
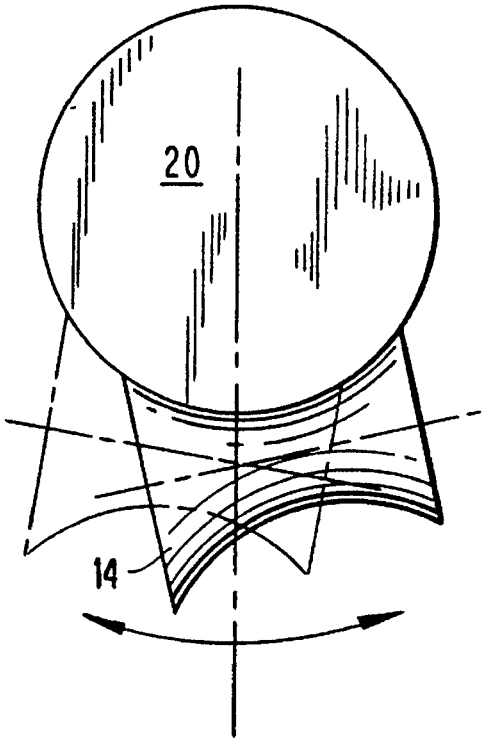
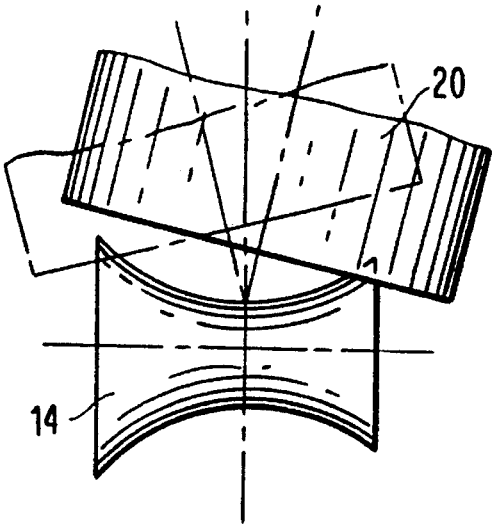
FIG. 9

METHOD FOR GRINDING NEEDLE POINTS ON SURGICAL GRADE NEEDLE BLANKS

This is a divisional of application Ser. No. 07/959,054 filed Oct. 9, 1992 now U.S. Pat. No. 5,388,374.

BACKGROUND OF THE INVENTION

1. Field of the Invention

This invention relates to apparatus and methods for grinding tapers or points on elongated stock and more particularly for grinding points on needle stock.

2. Description of the Related Art

The production of quality needles from raw stock involves many different processes and machinery. These varying processes and machinery become more critical in the preparation of surgical needles where the environment of intended use is in humans or animals. Some of the processes involved in the production of surgical grade needles include, inter alia: straightening spooled wire stock; cutting needle blanks from raw stock; providing a bore for receiving suture thread at one end of the blank; tapering or grinding points at the other end of the blank, flat pressing a portion of the needle barrel to facilitate easier grasping by surgical instrumentation; and, where curved needles are desired, curving the needle. During each of these several steps, extreme care must be taken to ensure that only the intended working of the needle is performed and that the other parts of the needle remain undisturbed.

Machines for grinding points of needles are known. Such machines include the Type NS 6, 8, 11 and 15 automatic point grinding machines available from SCHUMAG Machinery, Inc. of Norwood, N.J. Those machines utilize, for example, a transport wheel and saddle arrangement to present wire shafts to a grinding wheel so as to grind points on the ends of the shafts. A notched wheel is provided for spacing apart the wire shafts and presenting them to the grinding wheel surface. Different sized notched wheels are required for different wire shaft diameters. Thus, in order to change diameter shafts being ground, the appropriate notched wheel must first be installed before grinding of the differing diameter shaft needle blanks can take place. This requires shutting down production and fitting the machine with the appropriate notched wheel each time stock having a diameter not appropriate for the current wheel is to be ground.

Additionally, to operate efficiently, these machines require that the minimum wire shaft length must be longer than many of the surgical needles presently in use, thus necessitating additional finishing steps to refine the dimensions of the needles. Therefore, in order to form a finished needle, for example, having a length of 0.875 inches, stock of at least 1¾ inches would have to first be ground and then be clipped to the desired length. By performing the grinding first and then having a clip the needle shaft to the desired length, chances are increased that the needle point will become damaged during handling and clipping. Moreover, clipping the end of needle stock necessitates additional processing and quality control steps. Specifically, any burs or other irregularities created from the clipping must be removed and samples inspected to ensure the quality of the work.

Finally, grinding wheels employed by these known devices are typically of the bonded type which generally require frequent re-dressing. During use, the abrasive grains on bonded grinding wheels become slightly dulled. Normal stresses in the grinding operation should increase enough to tear the worn grain from the wheel to expose a new cutting grain. Thus, too soft a wheel wears too fast, losing grains before they are dulled, whereas, too hard a wheel develops a smooth glazed surface that will not cut properly. As the abrasives used on grinding wheel surfaces wear with continuous grinding, the wheel configuration changes enough to affect the grind on the finished product. When this occurs the wheel must then be re-dressed in the manner described above to open new abrasive grain surfaces or recondition the grinding surface so as to afford maximum cutting qualities. The process of dressing a grinding wheel is subjective, however, in that the dressing of a grinding wheel of the type used for grinding needle points usually requires an operator perform the dressing manually, therefore causing the geometry of the dressed wheel to vary, however slightly, from operator to operator. This variance in the grinding wheel surface causes differences in the finished needle point geometries which must conform to strict specifications. The result is a higher percentage of rejected parts and, therefore, increased operating and quality control costs.

Other methods are known for forming grinding wheels, for example, electroplating (a form of metal bonding) abrasive materials to a wheel core. The abrasive materials used for such bonding are typically abrasives such as diamond and cubic boron nitride which was developed by the General Electric Company and is available under the tradename Borazon. These specialized wheels offer many advantages not available with conventional vitrified, metal or resin bond wheels. Electroplated wheels may be custom designed to form requirements and therefore, offer immediate fast cutting as purchased. The cutting edges of super-abrasive materials do not break off as do those of conventional bonding materials. Instead, they wear down gradually over a long period of time. Therefore, grinding wheels plated with the above-mentioned abrasives provide the exact grinding surface geometry required for precision grinding without requiring dressing or re-dressing to generate and retain form. No break in period is required and wheel cores are reusable, thus reducing replacement costs. The present invention is directed toward apparatus and methods for grinding high quality surgical needles while avoiding the disadvantages of known devices.

SUMMARY OF THE INVENTION

The present invention provides a point-grinding apparatus which comprises frame means, workpiece transport means operably mounted on the frame means for transporting a plurality of elongated workpieces therealong, workpiece supporting means disposed adjacent the transport means for supporting the elongated workpieces in contact with the transport means and grinding means including an asymmetrical concave grinding surface disposed adjacent the transport means to engage workpieces supported by the workpiece supporting means. The asymmetrical concave grinding surface is configured and dimensioned such that a surface area of each workpiece which contacts the grinding surface varies relative to the position of the workpiece with respect to the grinding surface. The grinding means and workpiece transport means are preferably adjustable relative to the workpiece supporting means. The grinding means further comprises a wheel having abrasive grinding material electroplated onto the grinding surface.

In a preferred embodiment, the invention includes means disposed adjacent the transport means and the workpiece supporting means for storing the workpieces and supplying the workpieces to a feed point on the apparatus located between the workpiece transport means and the workpiece supporting. Preferably, the workpieces are supplied directly to the feed point. In this manner, the workpieces are individually positioned between the workpiece transport means and the workpiece supporting means. The workpiece storing and supplying means preferably includes a workpiece feed hopper cartridge having inlet means for receiving the workpieces, storage means for storing the workpieces and outlet means for discharging the workpieces directly to the feed point on the point-grinding apparatus. Also provided are means disposed adjacent the workpiece transport means and the workpiece supporting means for receiving the workpieces from an output point on the apparatus located between the workpiece transport means and the workpiece supporting means such that the workpieces are individually received from the output point into the receiving means.

A method for grinding needle points is also provided and includes the steps of, providing a rotating grinding wheel having an asymmetrical concave grinding surface and feeding at least one workpiece to a first position such that each at least one workpiece is advanced along the grinding surface. Preferably, the method further comprises the step of removing the workpiece from between the transport wheel and the workpiece support means at a second position thereof.

Another method is provided for grinding points on elongated workpieces and includes the steps of, providing a point-grinding apparatus having workpiece transport means for transporting a plurality of elongated workpieces across an asymmetrically concave grinding surface formed on a grinding structure disposed adjacent the transport means to grind workpieces positioned therebetween, rotating the workpiece transport means and the workpiece grinding means such that axes of rotation of the transport means and the grinding means are substantially transverse with respect to each other; and feeding an elongated workpiece to a first position to advance the workpiece along said grinding surface. Preferably, the method for grinding points on elongated workpieces further includes the step of removing the workpiece from between the transport means and the workpiece support means at a second position thereof.

BRIEF DESCRIPTION OF THE DRAWINGS

Preferred embodiments of the invention are described hereinbelow with reference to the drawings wherein:

FIG. 6 is a frontal view of the grinding and transport wheels of the invention, relatively adjusted to produce one exemplary needle point;

FIG. 7 is a view similar to FIG. 6 illustrating another possible adjustment of the grinding wheels to produce an alternative exemplary needle point;

FIG. 8 is a view similar to FIG. 6 illustrating another possible adjustment of the grinding and transport wheels to produce still another alternative exemplary needle point;

FIG. 9 plan view from above illustrating another possible adjustment of the transport and grinding wheels to produce still another alterative exemplary needle point;

DETAILED DESCRIPTION OF THE PREFERRED EMBODIMENTS

Figure 1:
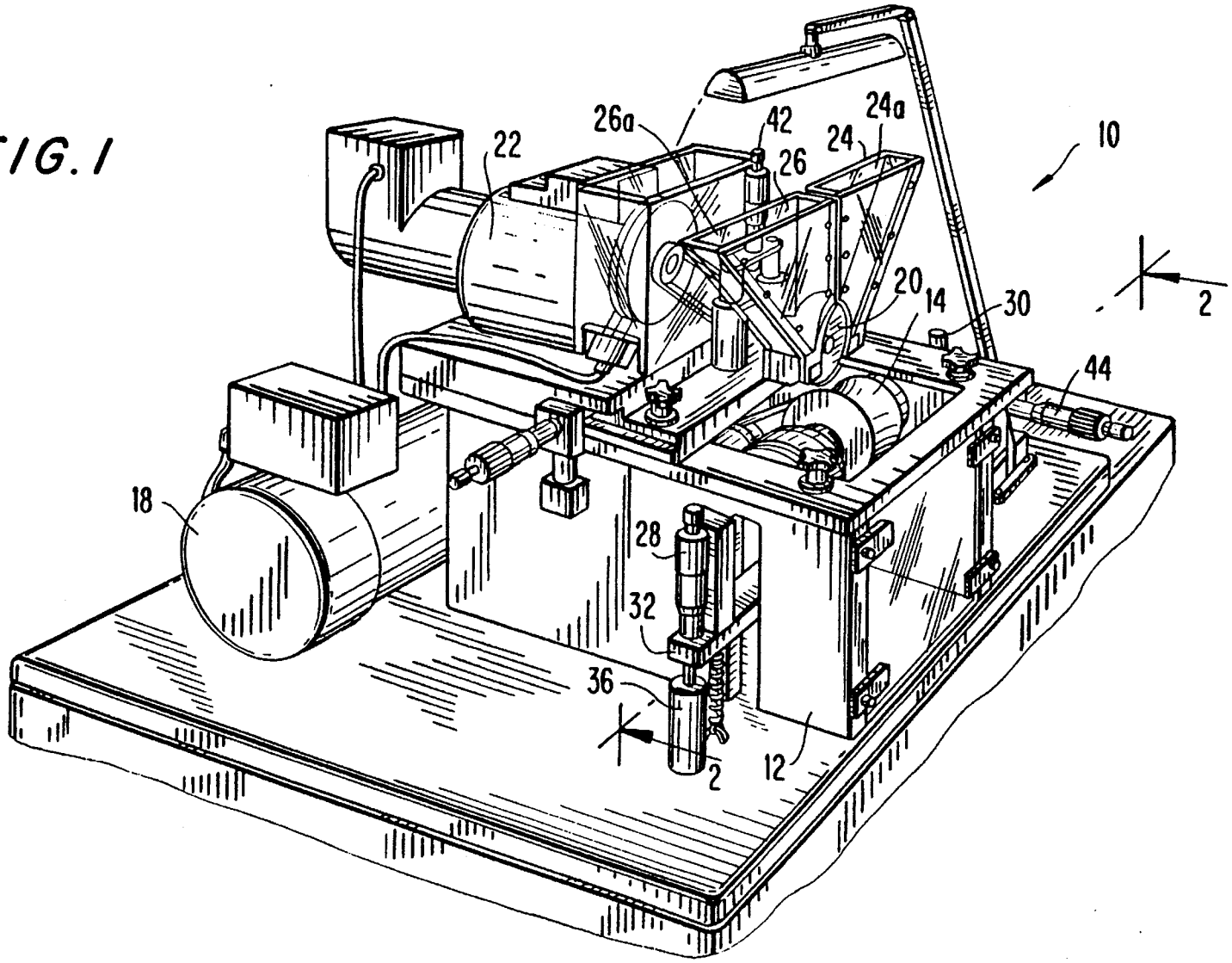
FIG. 1 is a perspective view of the grinding apparatus of the present invention.
Figure 2:
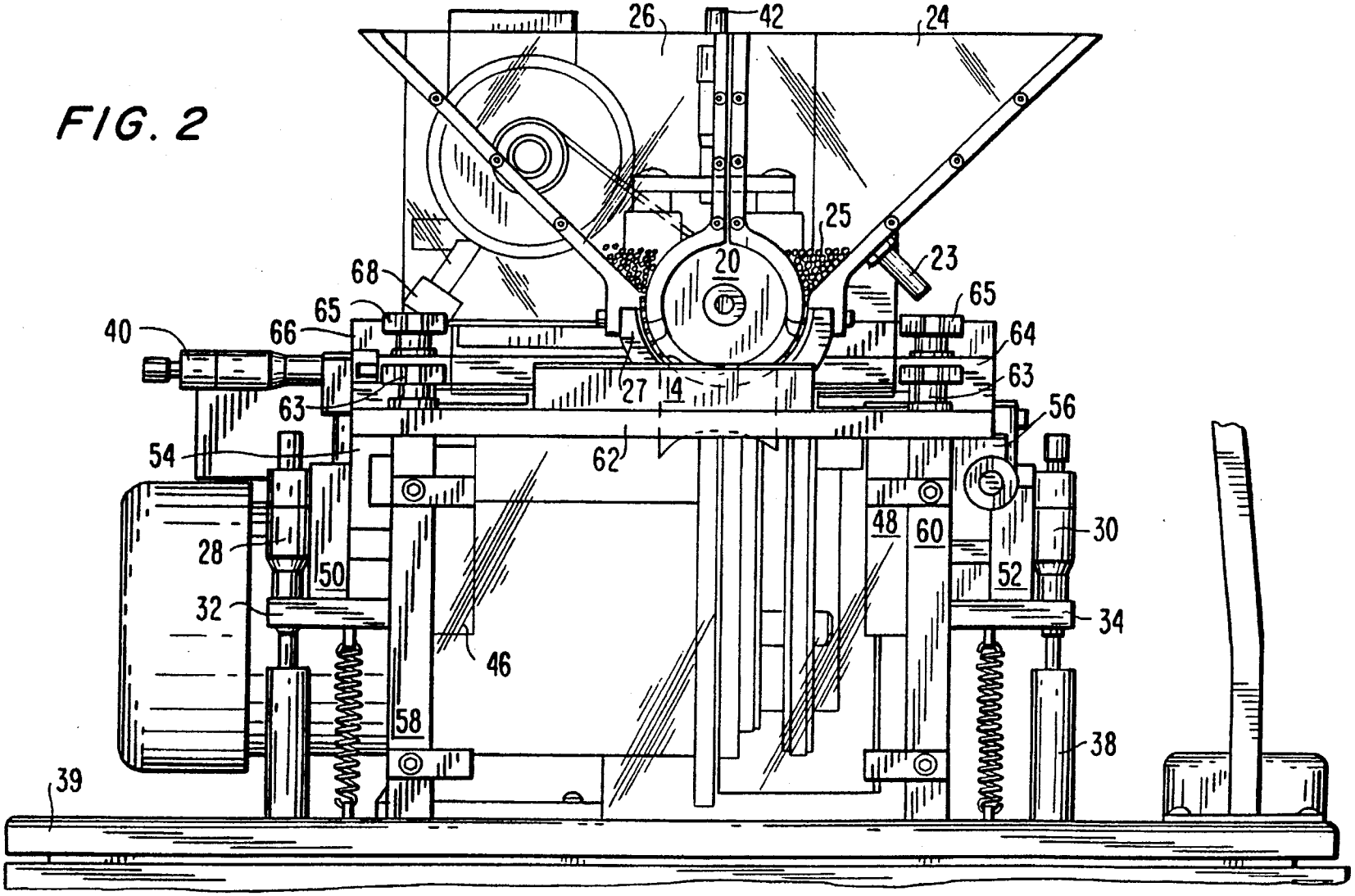
FIG. 2 illustrates a cross-sectional view of the grinding apparatus of the invention taken along line 2—2 of FIG. 1.

Referring now in specific detail to the drawings, in which like reference numerals identify similar or identical elements throughout the several views, and initially to FIGS. 1 and 2 which illustrate an apparatus particularly adapted for grinding points on needle stock, for example, point grinding apparatus 10. While the following description will focus on an apparatus and methods for grinding points on surgical needles, it will be appreciated by those having ordinary skill in the art that the present invention may be used to grind other objects as well. For example, the present invention may be used to grind points on many different types of elongated workpiece stock.

Apparatus 10 generally includes frame 12, grinding wheel 14, mounted on spindle 16 and driven by drive motor 18; and transport wheel 20, driven by motor 22. Unless otherwise noted, components of apparatus 10 are generally made of aluminum or tool steel. Grinding wheel 14 is preferably of the eletroplated type, having a core made of aluminum or other suitable material plated with an abrasive material such as Borazon. Alternatively, other known abrasive materials and bonding methods therefore, may also be substituted for Borazon, for example, diamond, aluminum oxide ($Al_2O_3$) or silicon carbide (SiC).

Figure 3:
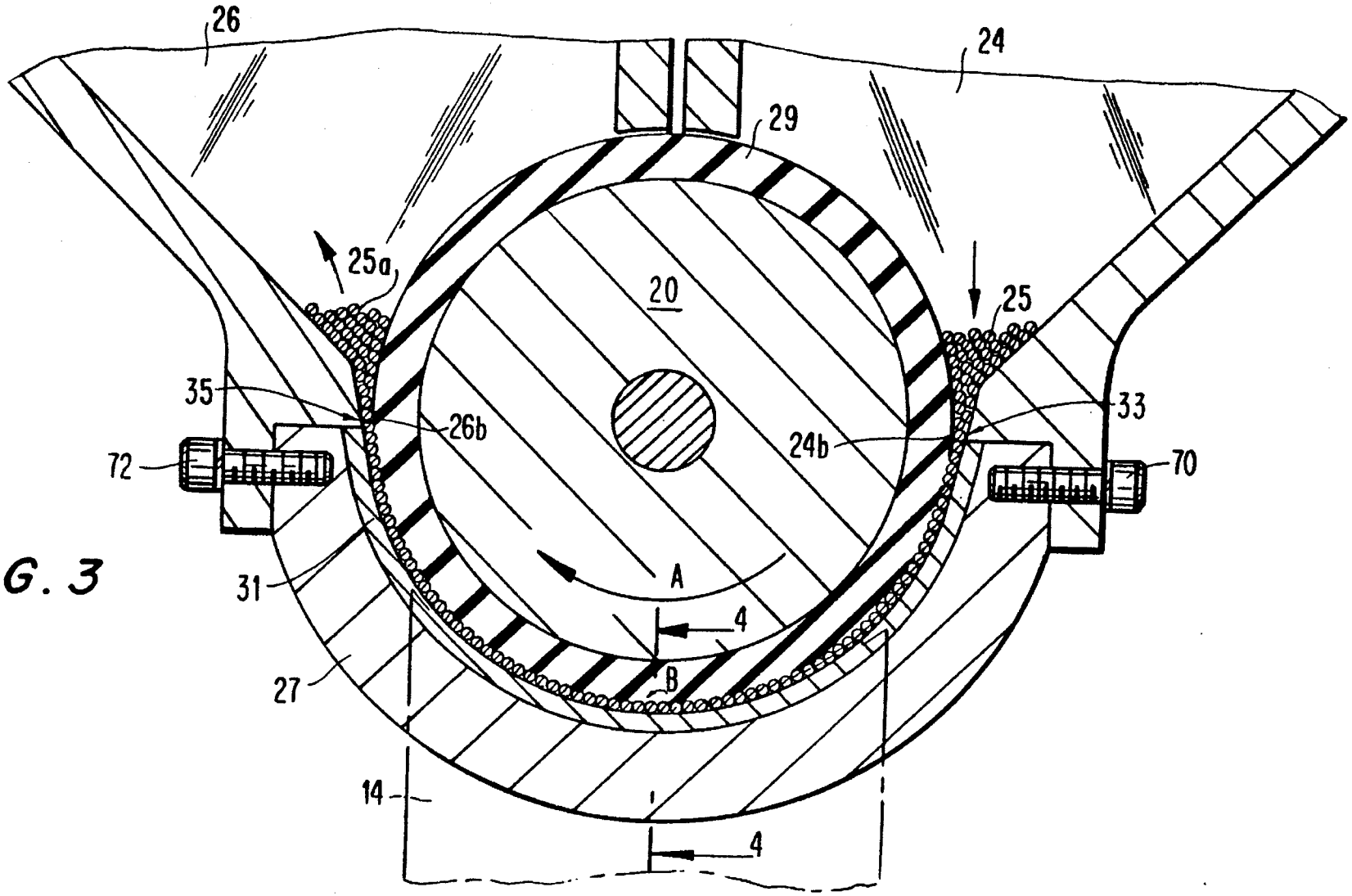
FIG. 3 is a cut-away partial front view of the apparatus of FIG. 1 illustrating the operation of the transport wheel and workpiece saddle.
Figure 5:
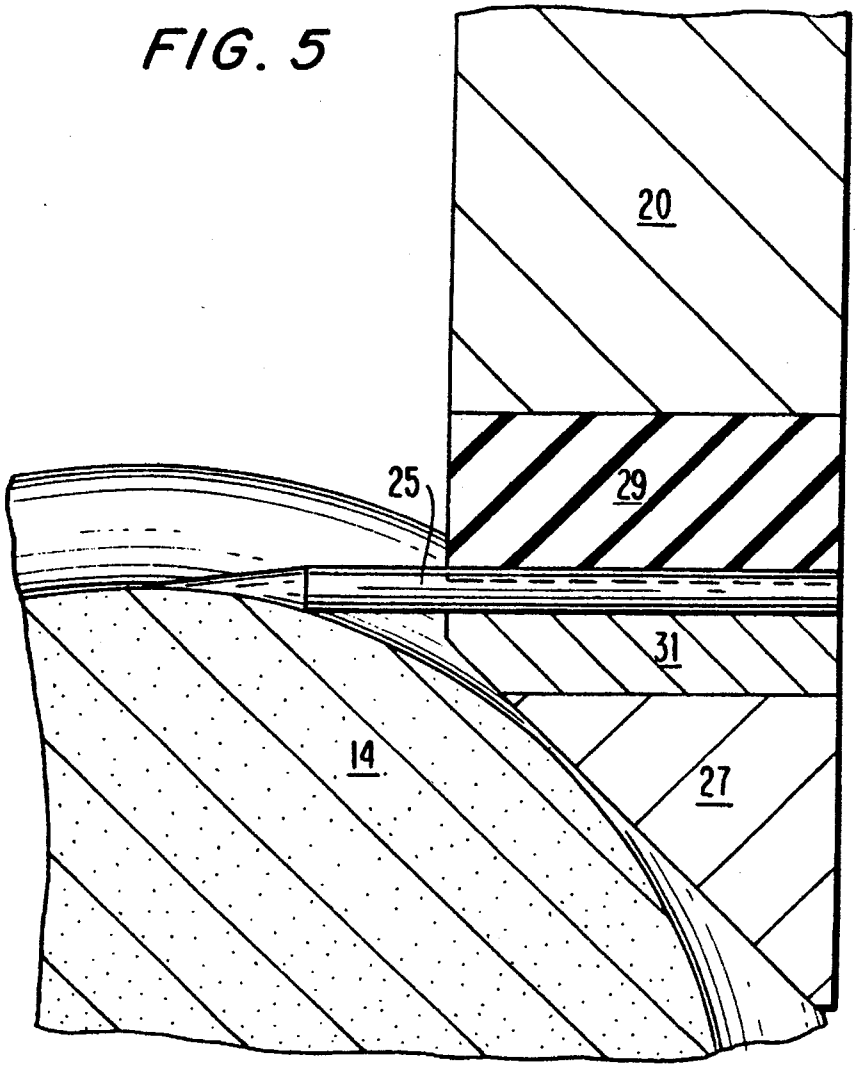
FIG. 5 is a view similar to FIG. 4 with the grinding and transport wheels adjusted for formation of a different needle point configuration.
Figure 4:
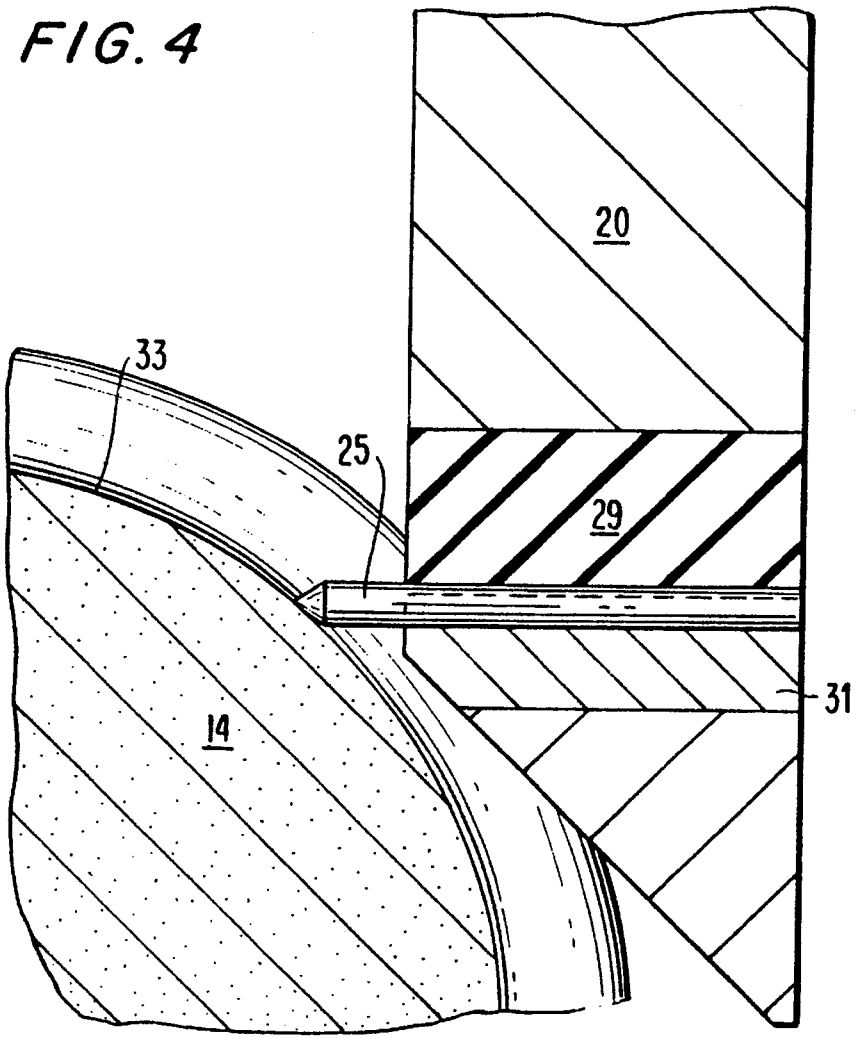
FIG. 4 is a cross-sectional view taken along line 4—4 of FIG. 3 illustrating the positioning of the needle stock relative to the grinding wheel of the present invention for one exemplary type of needle point.
Figure 11:
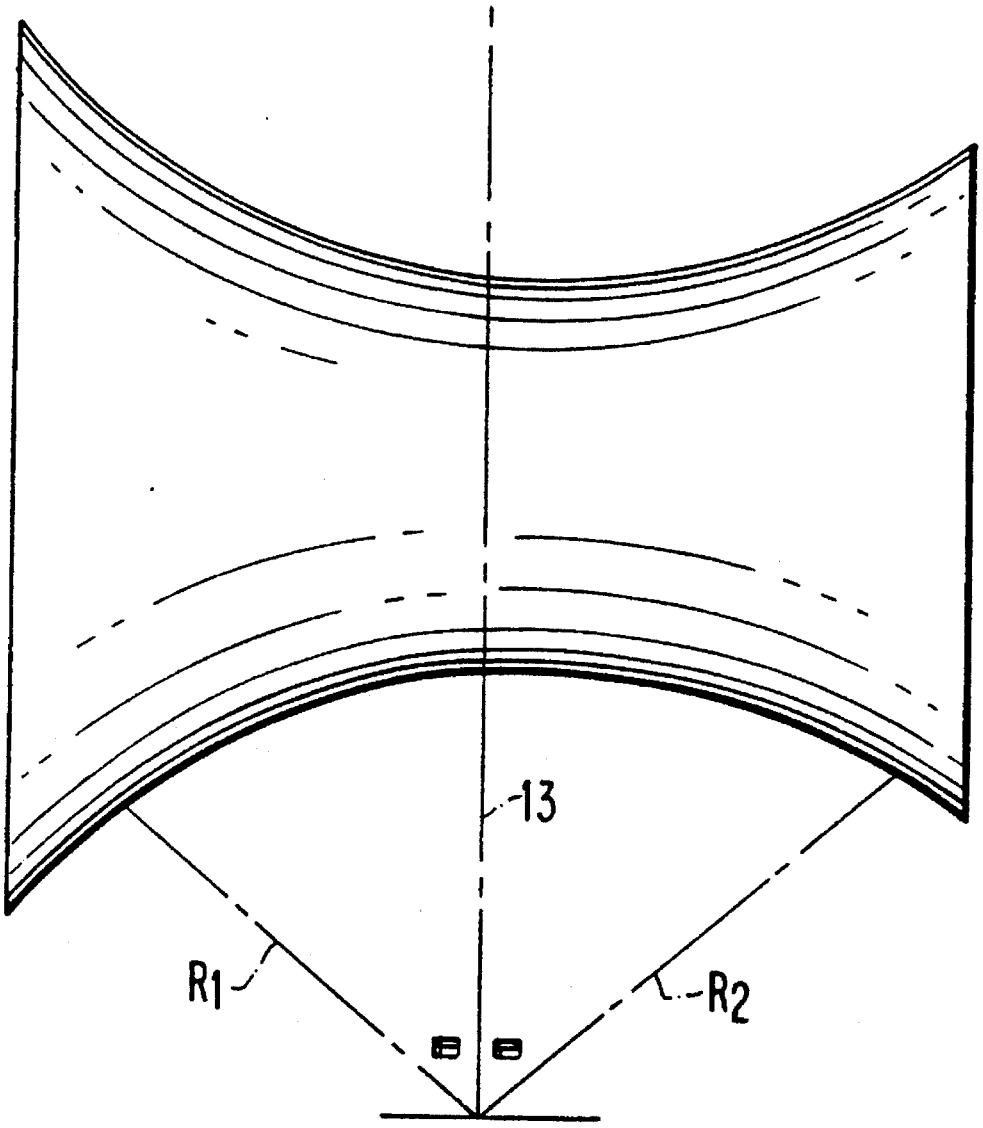
FIG. 11 is a plan view of the grinding wheel.

The geometry of grinding wheel 14 is unique in that it has a generally asymmetrical concave shape, with one end thereof having a greater diameter than the other end, as illustrated in FIGS. 3 (in phantom lines), 6–9 and 11. This asymmetrical shape is best illustrated in FIG. 11, where the surface of grinding wheel 14 is shown having unequal length radii of curvature $R_1$ and $R_2$ which are corresponding, in that each radius is formed at an angle O with respect to center line 13. In other words, the surface of grinding wheel 14 has radii of curvature on one side of center line 13 running through grinding wheel 14 which correspond to radii of curvature on the other side of center line 13 which are equally displaced therefrom. These corresponding radii of curvature are of unequal length. In prior grinding wheels, the corresponding radii of curvature are of equal length, i.e., prior grinding wheels have symmetrical grinding surfaces. The benefit of the present invention's grinding wheel geometry will become apparent from the description of the operation of apparatus 10 presented further below.

Saddle 27 is shaped to conform to the curvature of transport wheel 20 and is provided so that needle stock 25 are supported in contact with transport wheel 20 as they traverse the surface of grinding wheel 14. Frictional surfaces such as rubber layer 29 and rubber layer 31 are provided on saddle 27 and transport wheel 20, respectively, to supply traction for needle stock 25 travelling between the two surfaces. Workpiece storage is provided by feed hopper 24 and ground workpiece receiving is provided by off-load hopper 26. Hoppers 24 and 26 are provided to respectively deliver and receive workpieces, for example, needle stock 25, to feed point 33 and off-load point 35 between saddle 31 and transport wheel 20, before and after grinding takes place. Feed hopper 24 has inlet opening 24*a* for receiving workpieces 25 to be ground and outlet 24*b* for supplying workpieces 25 to feed point 33. Off-load hopper 26 has inlet portion 26*b* for receiving ground workpieces 25*a*. Also provided on off-load hopper 26 is opening 26*a* for removing ground workpieces 25*a*.

Alternatively, a workpiece agitating device may be provided on apparatus 10 to introduce vibrations within feed hopper 24. Other devices may be utilized, for example, pneumatically, hydraulically, or electrically operated devices mounted on apparatus 10 such that workpiece stock 25 is prevented from jamming at feed point 33.

Mounted on the side of feed hopper 24 is a sensing device such as photo sensor 23 which detects the presence of workpieces in the hopper. Banner reflective type photo sensors have been found effective, however, other suitable sensors may also be used. Sensor 23 is preferably mounted at a position near the bottom of feed hopper 24 so that when sensor 23 detects a low level of workpieces in the feed hopper, a warning signal is communicated to the operator. In a preferred embodiment, where it is intended that feed hopper 24 be attached to apparatus 10 when full and replaced with another full hopper when empty, it is preferred that sensor 23 triggers an alarm when the feed hopper is virtually empty. In this manner, another feed hopper can be attached to apparatus 10 for grinding of another batch of workpieces. In another embodiment, where the feed hopper is intended to remain fixed to apparatus 10, it is preferred that a sufficient amount of stock remain in feed hopper 24 at the time sensor 23 triggers an alarm, in order that feed hopper 24 can be refilled without unnecessary interruption of the production process.

Grinding wheel adjusting devices, for example, micrometers 28 and 30, are mounted on blocks 32 and 34 and rest on micrometer bearing posts 36 and 38, respectively, for adjusting the position of the longitudinal axis of grinding wheel 14. Other adjusting devices are provided for adjusting the vertical and horizontally pivotal relationship of transport wheel 20 with respect to grinding wheel 14. Together the different adjustment capabilities allow for precision grinding of the needle stock.

OPERATION

Referring to FIGS. 3–10, the operation of grinding apparatus 10 will now be discussed. Feed hopper 24 is supplied with needle stock 25 and mounted on workpiece saddle 27 by threaded screw 70 or any other suitable fastener. Grinding wheel 14 is rotated counter-clockwise, at a rate of approximately 1,000 to 20,000 revolutions per minute by grinding wheel drive motor 18. The preferred operating speed of grinding wheel 14 depends on the diameter of the wire, the diameter of the wheel 14, the type of wire and wheel materials used as well as surface finish requirements. Transport wheel 20 is rotated by transport wheel drive motor 22 in an orientation substantially transverse to the rotation of grinding wheel 14, in a counter-clockwise direction as indicated by arrow A. However, transport wheel 20 is rotated much slower than grinding wheel 14, at a rate of approximately 1 to 5 revolutions per minute depending on the diameter of the wire, diameter of the transport wheel 20, wire material, wheel material and surface finish requirements. One skilled in the art will appreciate that the direction of travel of the grinding wheel and the transport wheel may be reversed so that the operation would work in the reverse direction.

Needle stock 25 are fed between transport wheel 20 and saddle 27 at feed point 33, thereby frictionally contacting rubber layer 29 and rubber layer 31 of transport wheel 20 and saddle 27, respectively. A contact force is applied to the needle stock from downward pressure provided thereon by transport wheel 20, which force causes the ends of needle stock 25 to contact grinding wheel 14. The pressure exerted by transport wheel 20 on the needle stock may be adjusted by micrometer 42 to either raise or lower transport wheel 20. As needle stock 25 are advanced along the surface of grinding wheel 14, the rotation of transport wheel 20 and frictional contact with rubber layers 29 and 31 causes the stock to rotate in the direction of arrow B so that the ends of needle stock 25 are evenly exposed to the grinding action of grinding wheel 14.

Figure 10:
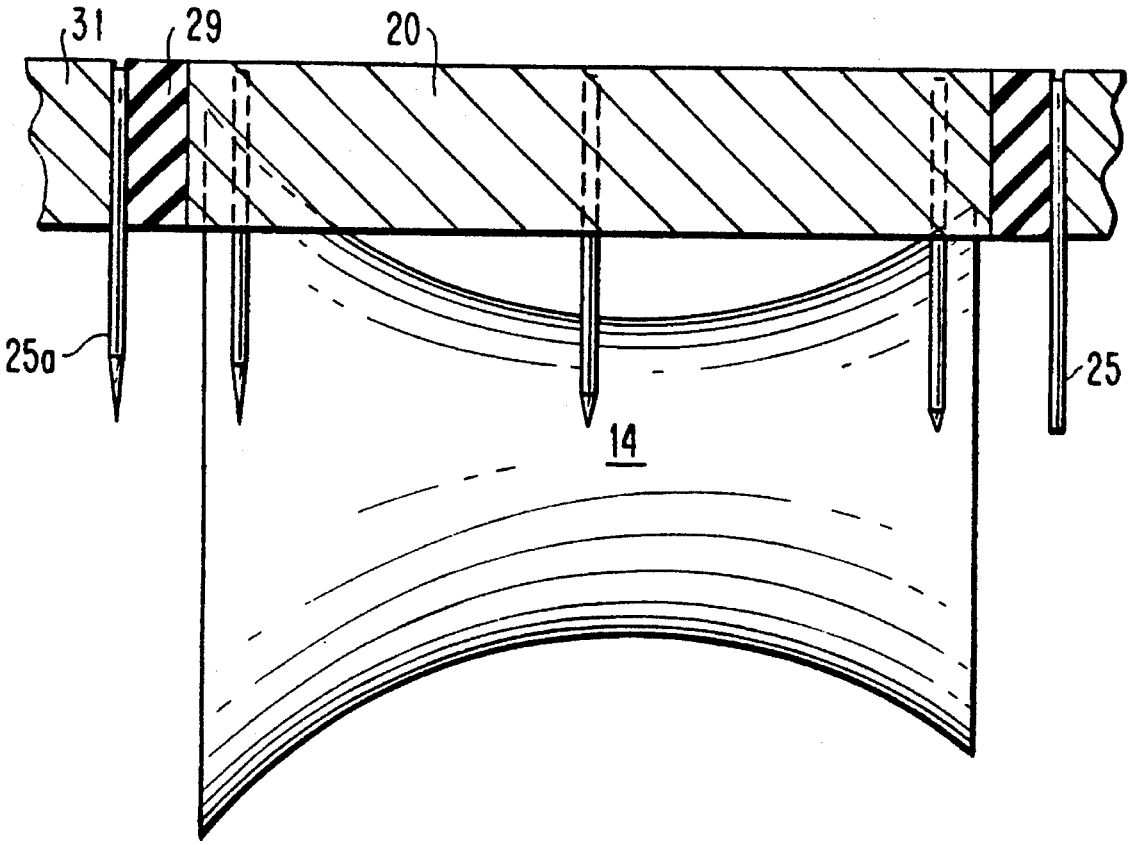
FIG. 10 is a partial cross-sectional view from above, illustrating the ground state of needles at selected locations along the surface of the grinding wheel.

Referring to FIG. 10, as needle stock 25 are moved along the surface of grinding wheel 14, an increasing length of each needle stock makes contact with the grinding wheel so that the desired taper point is formed at the end of the workpiece. Other adjustments notwithstanding, this gradual exposure of an increasing longitudinal portion of the needle stock to the grinding surface is caused by the unique configuration and geometry of grinding wheel 14 as set forth above. This gradual exposure to the grinding surface allows for the tapered point formation, i.e., more material being removed from the very end of the stock while proportionately less material is removed from along the length of the needle stock shaft. The unique configuration of grinding wheel 14 allows this incremental grinding to take place while the grinding wheel remains transverse to transport wheel 20. Appropriate adjustments could be made, as noted in the description above, to skew the longitudinal axes of the transport and grinding wheels, should it become desirable or necessary to do so.

At the end of one pass across grinding wheel 14, needle stock 25*a* exit at point 35 and are deposited into off-load hopper 26. Some point configurations may require more than one pass over the grinding surface or different adjustment of the transport and/or grinding wheels' alignment depending on the type of material being ground or the point desired. In these instances, a full batch of needle stock 25 are completed one pass at a time until sufficient material has been removed from each needle stock workpiece 25.

The length of the finished needle point (FIGS. 4 and 5) may be controlled by moving platform 66 with transport wheel drive motor 22 mounted thereon toward or away from grinding wheel 14 and raising or lowering grinding wheel 14 with respect to transport wheel 20. To move transport wheel 20 toward or away from grinding wheel 14, hand screws 65 are loosened sufficiently to allow movement of platform 66 within slots (not shown) provided thereon. To raise or lower grinding wheel 14, micrometers 28 and 30 (FIG. 2) are adjusted, causing spindle blocks 46 and 48 to raise or lower spindle 16 (FIG. 1) which moves grinding wheel 14 up or down with respect to transport wheel 20.

FIGS. 6–9 illustrate other adjustments which may be used to form different needle point geometries. Particularly, FIGS. 6–8 illustrate other adjustments for grinding wheel 14. For example, grinding wheel 14 may be moved horizontally or vertically with respect to the face of transport wheel 20 as shown in FIGS. 6 and 7, respectively. Grinding wheel 14 may also be skewed with respect to the face of transport wheel 10 as shown in FIG. 8. FIG. 9 shows one possible adjustment for transport wheel 20 with respect to grinding wheel 14 wherein transport wheel 20 may be skewed along a horizontal plane formed with grinding wheel 14 as seen in the top view shown.

Figure 12:
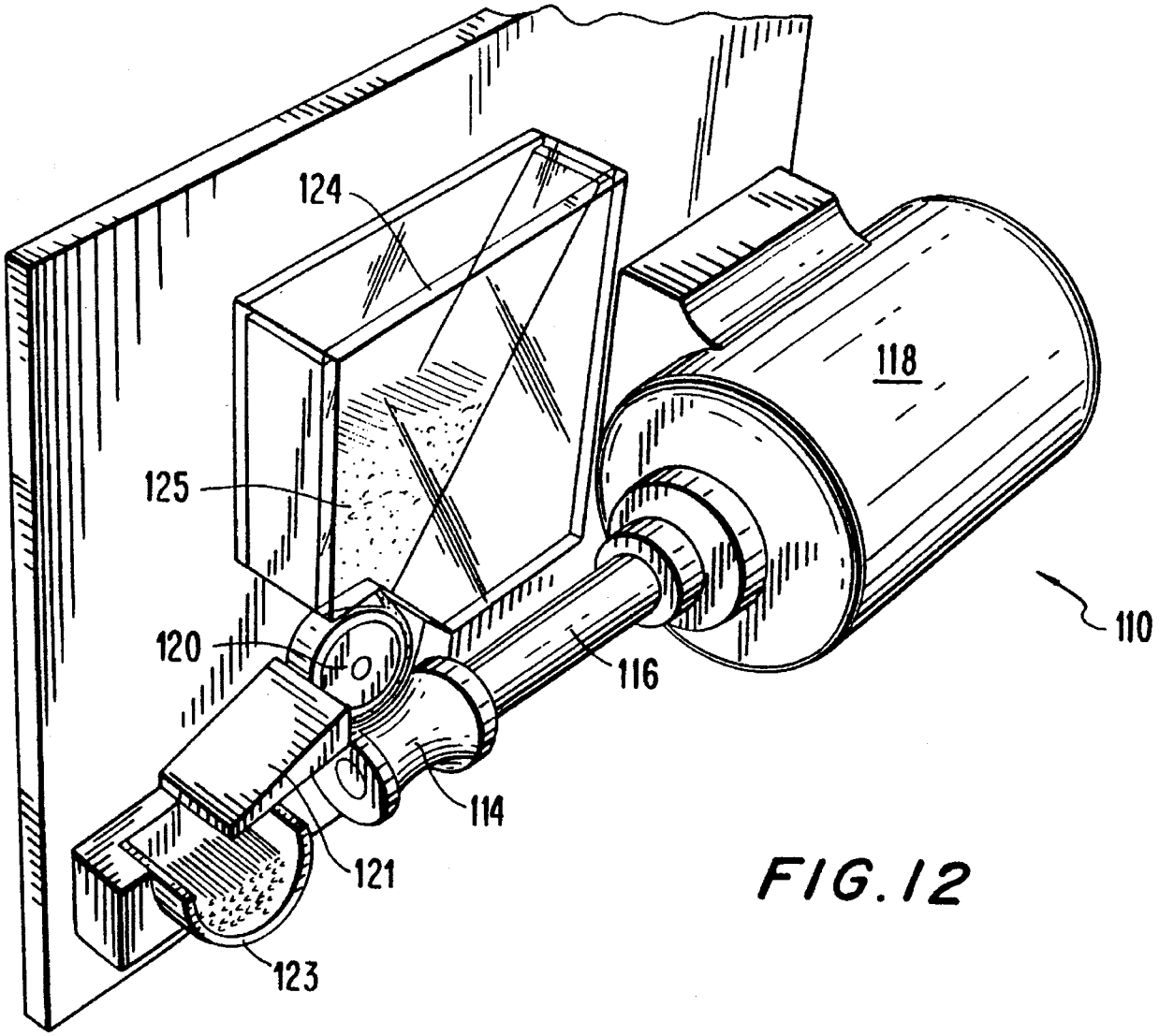
FIG. 12 is a perspective view of an alternative embodiment of the point grinding apparatus of the present invention.

In FIG. 12 another embodiment of the present invention apparatus 110 is illustrated having grinding wheel 114 attached to drive motor 118 by spindle 116. Grinding wheel 114 has the same unique geometry as that described above for grinding wheel 14 except that grinding wheel 114 is a much smaller version with a maximum diameter on the order of one inch. Transport wheel 120 is provided and is driven by a drive motor (not shown). The operation of apparatus is similar to that of that described above for apparatus 10. Apparatus 110 is useful for grinding points on extremely small surgical needles such as those used for microsurgery, ophthalmic surgery and plastic surgery. In the embodiment of FIG. 12, only feed hopper 124 is shown. Needle stock 125 are ground and fed to ramp 121 which they roll or slide down into bin 123. It is also envisioned that apparatus 110 could be provided with an off-load hopper as described and illustrated for apparatus 10.

While the invention has been particularly shown and described with reference to the preferred embodiments, it will be understood by those skilled in the art that various modifications in form and detail may be made therein without departing from the scope and spirit of the invention. Accordingly, modifications such as those suggested above, but not limited thereto, are to be considered within the scope of the invention.

What is claimed is:

1. Method for grinding needle points on surgical grade needle blanks comprising the steps of:

(a) providing a surgical needle grinding apparatus having a transport wheel;

a support saddle having first and second ends and defining a curvature corresponding to a curvature of the transport wheel, the support saddle adjustably positioned adjacent the transport wheel to frictionally hold elongated surgical grade needle blanks therebetween, wherein a feed point is defined by the juxtaposition of the first end of the support saddle and the transport wheel;

a grinding wheel having an asymmetrically concave grinding surface disposed adjacent the transport wheel and the support saddle;

(b) rotating the transport wheel;

(c) rotating the grinding wheel; and (d) feeding at least one elongated surgical grade needle blank to the feed point such that each at least one workpiece is advanced along the asymmetrically concave grinding surface.

2. The method for grinding needle points according to claim 1 further comprising the step of:

(c) removing the at least one elongated surgical grade needle blank from between the transport wheel and the support saddle at the second end of the saddle.

3. Method for grinding needle points on elongated surgical grade needle blanks comprising the steps of:

(a) providing a surgical needle point-grinding apparatus having a transport wheel; an asymmetrically concave grinding surface formed on a grinding wheel rotatably disposed adjacent the transport wheel to grind points on elongated surgical grade needle blanks positioned therebetween;

(b) rotating the transport wheel and the grinding wheel such that axes of rotation of the transport wheel and the grinding wheel are substantially transverse with respect to each other; and (c) feeding at least one of the elongated surgical grade needle blanks to a first position to advance the at least one elongated surgical grade needle blank along the grinding surface such that an end portion of the at least one elongated surgical grade needle blanks contacts the grinding surface.

4. The method for grinding needle points on elongated surgical grade needle blanks according to claim 3 further comprising the step of:

(d) removing the at least one elongated surgical grade needle blank from between the transport wheel and the support saddle at a second end of the support saddle.

5. Method for grinding needle points on elongated surgical grade needle blanks, comprising the steps of:

(a) providing a surgical needle point-grinding apparatus which includes:

a transport wheel;

a support saddle having first and second ends and defining a curvature corresponding to a curvature of the transport wheel, the support saddle adjustably positioned adjacent the transport wheel to frictionally hold elongated surgical grade needle blanks therebetween, wherein a feed point is defined by the juxtaposition of the first end of the support saddle and the transport wheel;

a grinding wheel having an asymmetrically concave grinding surface disposed adjacent the transport wheel and the support saddle;

a feed hopper cartridge positioned adjacent the feed point and configured and dimensioned to hold a plurality of elongated surgical grade needle blanks therein, the feed hopper cartridge defining an outlet configured and dimensioned to permit the discharge of one of the plurality of elongated surgical grade needle blanks at a time directly to the feed point (b) rotating the transport wheel and the grinding wheel such that axes of rotation of the transport wheel and the grinding wheel are substantially transverse with respect to each other; and (c) feeding at least one of the elongated surgical grade needle blanks directly from the outlet of the feed hopper cartridge to the feed point such that the at least one elongated surgical grade needle blank is advanced along the grinding surface by the interaction of the transport wheel and support saddle with the at least one surgical grade needle blank.

6. The method for grinding needle points according to claim 5 further comprising the step of:

(d) agitating the elongated surgical grade needle blanks prior to the step of feeding at least one elongated surgical grade needle blank to the feed point.

7. The method for grinding needle points according to claim 5, wherein the at least one of the elongated surgical grade needle blanks of the feeding step is a microsurgery needle blank.

8. The method for grinding needle points according to claim 5, wherein the at least one of the elongated surgical grade needle blanks of the feeding step is an opthalmic needle blank.

9. The method for grinding needle points according to claim 5, further comprising the step of:

(d) receiving the at least one of the elongated surgical grade needle blanks in an off-load hopper.

10. The method for grinding needle points according to claim 1, further comprising the step of:

(c) agitating the elongated surgical grade needle blanks prior to the step of feeding at least one elongated surgical grade needle blank to the feed point.

11. The method for grinding needle points according to claim 1, wherein the at least one elongated surgical grade needle blank of the feeding step is a microsurgery needle blank.

12. The method for grinding needle points according to claim 1, wherein the at least one elongated surgical grade needle blank of the feeding step is an opthalmic needle blank.

13. The method for grinding needle points according to claim 1, further comprising the step of:

(d) receiving the at least one elongated surgical grade needle blank in an off-load hopper.

14. The method for grinding needle points according to claim 3 further comprising the step of:

(d) agitating the elongated surgical grade needle blanks prior to the step of feeding at least one elongated surgical grade needle blank to the first position.

15. The method for grinding needle points according to claim 3, wherein the at least one of the elongated surgical grade needle blanks of the feeding step is a microsurgery needle blank.

16. The method for grinding needle points according to claim 3, wherein the at least one of the elongated surgical grade needle blanks of the feeding step is an opthalmic needle blank.

17. The method for grinding needle points according to claim 3, further comprising the step of:

(d) receiving the at least one of the elongated surgical grade needle blanks in an off-load hopper.

* * * * *